US006023998A

United States Patent [19]

Frey

[11] Patent Number: 6,023,998

[45] Date of Patent: Feb. 15, 2000

[54] SHINGLE REMOVING IMPLEMENT

[76] Inventor: John Frey, 220 W. Hamlet Rd., Newcastle, Me. 04553

[21] Appl. No.: 09/166,772

[22] Filed: Oct. 5, 1998

[51] Int. Cl.[7] ..... E04D 15/00

[52] U.S. Cl. ..... 81/45; 254/131.5

[58] Field of Search ..... 81/46, 45; 254/25, 254/131, 131.5, 18, 21

[56] References Cited

U.S. PATENT DOCUMENTS

| | | | |
|---|---|---|---|
| 2,716,538 | 8/1955 | Arrowood | 254/131.5 |
| 4,086,699 | 5/1978 | Olkkola | 254/131.5 X |
| 4,203,210 | 5/1980 | Hadlick, Jr. | 254/131.5 X |
| 5,813,295 | 9/1998 | Jensen, Jr. | 254/21 |

FOREIGN PATENT DOCUMENTS

| | | | |
|---|---|---|---|
| 38120 | 1/1915 | Denmark | 254/131.5 |
| 210799 | 10/1940 | Switzerland | 254/131.5 |

*Primary Examiner*—D. S. Meislin

*Attorney, Agent, or Firm*—Frederick R. Cantor, Esq.; Arthur J. O'Dea

[57] ABSTRACT

A shingle removing implement can include a flat blade adapted to be inserted underneath the designated shingle, and an elongated handle extending a substantial distance from the blade to cause the blade to exert a lifting action on the shingle. An arcuate plate is secured to the back surface of the blade, to form a wedge structure that facilitates a prying action of the blade on the shingle.

4 Claims, 1 Drawing Sheet

SHINGLE REMOVING IMPLEMENT

BACKGROUND OF THE PRESENT INVENTION

SUMMARY OF THE PRESENT INVENTION

This invention relates to an implement for removing shingles from a building roof in an orderly and systematic fashion. The implement is designed to make the shingle-removal operation easier and quicker for the human operator.

Typically, shingles are removed from a building roof by using a chisel or pry bar. The process involves inserting the chisel or pry bar underneath the uppermost shingle and then lift the exposed end of the chisel or pry bar to push the uppermost shingle away from the underlying shingles. The process is time-consuming and relatively inefficient. Usually several back-and-forth motions of the chisel are required to remove a given shingle from the roof surface.

The present invention relates to an implement for removing a shingle from a roof surface quickly and with less effort on the part of the human operator of the implement. In preferred practice of the invention, the implement comprises a relatively wide flat blade having a leading edge adapted to be inserted underneath the exposed edge of the shingle that is to be removed, and a trailing edge connected to an elongated handle. The handle can be used as a lever to cause the blade to exert a lifting force on the shingle.

The blade is preferably equipped with an angulated plate on its rear surface, so that when the blade is shoved underneath the shingle the angulated plate supports the blade against downward deflection by the reaction force generated by the shingle. The blade is maintained at an acute angle to the shingle (roof) plane, so that the blade exerts maximum lift force on the overlying shingle.

A V-shaped cutting edge is inset into the blade leading edge for cutting through the shingle after the blade has advanced a predetermined distance along the single lower surface. The shingle can thus be cut into sections during the shingle lifting operation, thereby facilitating the shingle removal process.

Further features of the invention will be apparent from the attached drawing and description of an illustrative embodiment of the invention.

In summary, and in accordance with the above discussion, the foregoing objectives are achieved in the following described embodiments.

1. An implement for removing shingles from a building roof comprising:

a blade having a leading edge adapted to be inserted into the joint between a first lower shingle forming an underlayer, and a second upper shingle forming an upperlayer;

an elongated handle connected to said blade for advancing said blade into the joint, whereby the handle can then be used as a lever to lift said second shingle away from said first shingle; and said handle extending a substantial distance from said blade.

2. The implement, as described in paragraph 1, and further comprising means for maintaining said blade at an acute angle to the plane of the shingles when said blade is advanced into the shingle joint, whereby said upper shingle is automatically wedged upwardly away from said lower shingle.

3. The implement, as described in paragraph 2, wherein said means for maintaining the blade at an acute angle to the shingle plane comprises a plate acutely angled to the blade plane; and said plate having a first end thereof attached to said blade at a point spaced from the blade leading edge and a second end spaced from the blade surface near the point where said handle is connected to said blade.

4. The implement, as described in paragraph 1, wherein said blade has an upper surface adapted to engage the undersurface of said upper shingle when the blade is advanced into the joint between said upper and lower shingles;

said blade having an undersurface; and a plate attached to the blade under surface for maintaining the blade at an acute angle to the shingle plane when the blade is advanced into the joint between the upper and lower shingles.

5. The implement, as described in paragraph 4, wherein said plate has a first end thereof attached to said blade at a point set back slightly from the blade leading edge, and a second end thereof spaced from the blade undersurface.

6. The implement, as described in paragraph 5, wherein said plate has an undersurface that has a slight convex curvature.

7. The implement, as described in paragraph 1, wherein the blade leading edge has an inset shingle cutter means adapted to cut through the upper shingle when said blade has advanced a predetermined distance into the joint between said upper and lower shingles.

8. The implement, as described in paragraph 7, wherein said shingle cutter means comprises a V-shaped cutting edge indented into the blade leading edge.

9. The implement, as described in paragraph 8, and further comprising plural nail-puller grooves indented into the blade leading edge.

10. The implement, as described in paragraph 1, and further comprising plural nail-puller grooves indented into the blade leading edge.

11. An implement for removing shingles from a building roof comprising:

a flat blade having a leading edge and a trailing edge; said blade having an upper surface and a lower surface;

a handle connected to the blade upper surface proximate to the blade trailing edge;

a plate connected to the blade lower surface for maintaining said blade at an acute angle to the shingle plane when said blade is shoved into the joint between an upper shingle and a lower shingle;

said plate having a first end thereof connected to the blade lower surface at a point proximate to the blade leading edge; and said plate having a second end thereof spaced from the blade lower surface at a point proximate to the blade trailing edge.

12. The implement, as described in paragraph 11, and further comprising a V-shaped shingle cutting edge indented into the blade leading edge, and plural nail-puller grooves indented into the blade leading edge;

said blade having two side edges connecting the blade leading edge and blade trailing edge; and said V-shaped shingle cutting edge being located in close proximity to one of the blade side edges.

DESCRIPTION OF THE PREFERRED EMBODIMENTS OF THE PRESENT INVENTION

Figure 1:
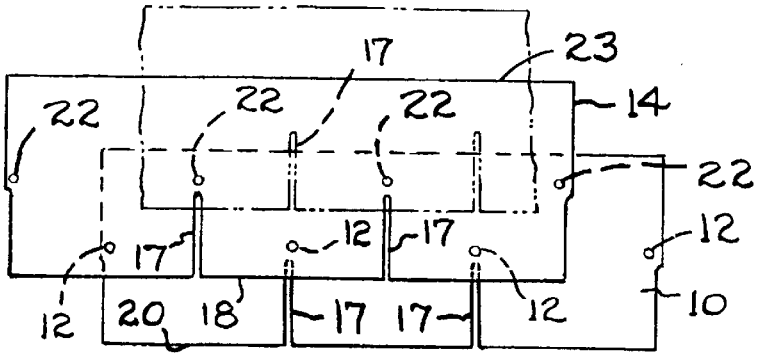
FIG. 1, is a fragmentary plan view, of a shingled roof that can be de-shingled with an implement of the present invention.

FIG. 1, is a fragmentary plan view, of a shingled roof that can be de-shingled with an implement of the present invention.

FIG. 1 is a fragmentary plan view of a shingled roof that can have the shingles removed with implements constructed according to the invention. The illustrated roof includes a lower shingle 10 secured to the roof surface by four roofing nails 12. An upper shingle 14 partially overlaps shingle 16 so that lower edge 18 of shingle 16 is spaced above the lower edge 20 of shingle 10. Each shingle has two slots 17 extending upwardly from its lower edge for ornamental purposes. The upper edge of each slot is concealed by the overlying shingle.

Roof nails 22 extend through shingles 14 and 10 to secure the two shingles to the roof surface. Thus, each shingle is secured by two rows of nails located near the shingle upper edge and at approximately the mid point between the shingle upper and lower edges. Additionally, a thin strip of adhesive can be provided on the upper surface of each shingle to secure the edge area of each overlying shingle to the associated underlying shingle.

Figure 6:
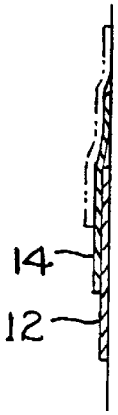
FIG. 6, is a fragmentary sectional view, taken on line 6—6 in FIG. 1.

FIG. 6, is a fragmentary sectional view, taken on line 6—6 in FIG. 1.

FIGS. 1 and 6 are fragmentary in nature. The shingle arrangement is duplicated along the entire roof surface to form a shingled roof.

The present invention is concerned with an implement 24 for removing worn shingles singly, one by one, from the roof surface, whereby the roof can be reshingled. Implement 24 comprises a flat blade 26, preferably formed of steel, and an elongated handle 28 formed out of wood or plastic.

Blade 26 has a leading edge 30 adapted to extend underneath the overlying shingle, e.g. shingle 14, and a trailing edge 32 spaced from edge 30 by a substantial distance. An integral tubular extension 34 of the blade serves as a socket to connect the elongated handle 28 to the blade. The elongated handle has a hand grip 36. Blade 26 has two straight side edges 38 connecting the blade trailing edge to the blade leading edge. Blade 26 is preformed of steel having a thickness of about 0.07 inch.

The total length of the implement can be about forty inches. Blade 26 can have a length (between edges 30 and 32) of about twelve inches, and a width (between edges 38) of about eight inches.

Leading edge 30 of the blade has a sharpened cutting edge 40 inset into the blade plan dimension. Cutting edge 40 comprises two acutely angled cutter edge sections 42 forming a V-shaped cutter construction adapted to cut the overlying shingle as the implement advances underneath the respective overlying shingle. Each edge section 42 is sharpened, to provide a knife edge sharpness.

Leading edge 30 of the blade also has a number of nail puller grooves 44 indented into the blade surface. Each groove 44 is adapted to fit onto the shank of a roofing nail (e.g. nail 12 or nail 22) when the implement is advanced underneath the overlying shingle (e.g. shingle 14).

The upper (front) surface of blade 26 has a flat unobstructed contour. The lower (rear) surface 46 of the blade has attached thereto an angled plate 48 that acts to maintain the blade at an acute angle to the shingle plane when the blade is advanced underneath the exposed (overlying) shingle, e.g. shingle 14. Plate 48 reinforces blade 26 against deflection by the reaction force generated by the overlying shingle.

Figure 2:
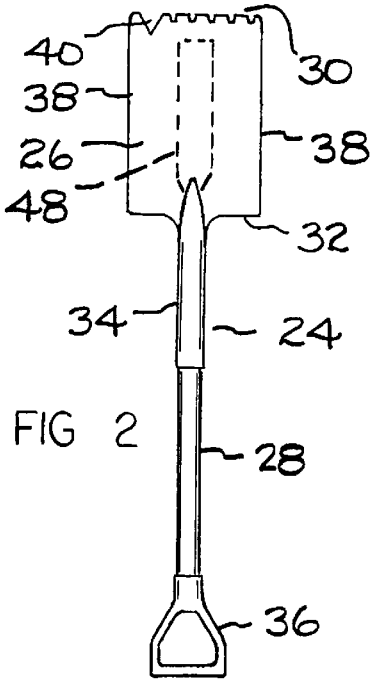
FIG. 2, is a plan view, of a shingle-removing implement embodying the present invention.
Figure 3:
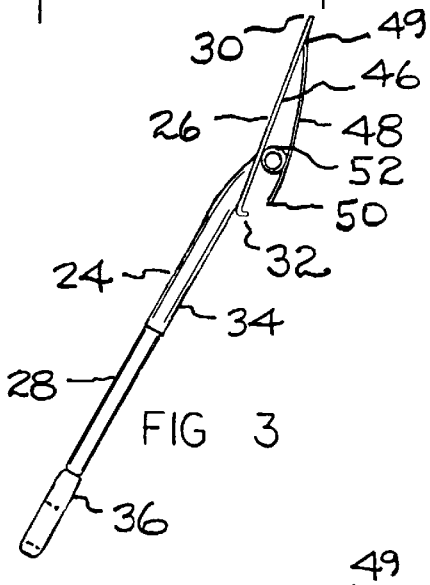
FIG. 3, is a side view, of the FIG. 2 implement.
Figure 5:
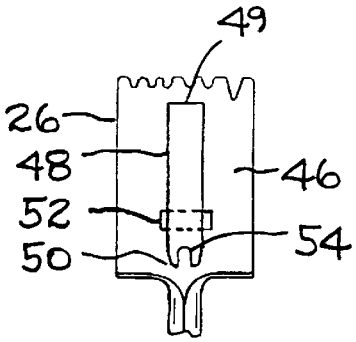
FIG. 5, is a rear view, of the blade used in the FIG. 1 implement.
Figure 4:
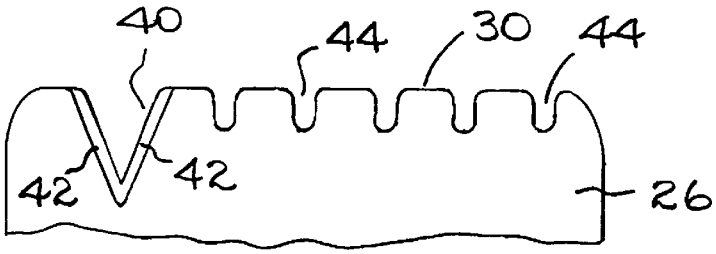
FIG. 4, is a fragmentary enlarged view, of the leading edge of the blade used in the FIG. 1 implement.

FIG. 3, is a side view, of the FIG. 2 implement.

Plate 48 has an end 49 connected to blade surface 46 at a point proximate to the blade leading edge 30, and a second end 50 located near the blade trailing edge 32. As shown in FIG. 3, end 50 of the plate is spaced from the blade rear surface 46, whereby the blade and plate cooperatively form a wedge structure adapted to exert a lift action on the overlying shingle as blade leading edge 30 is advanced underneath a shingle. A tubular spacer 52 is located between blade surface 46 and plate 48 to rigidify the wedge structure against deflection by load forces. End 50 of plate 48 has a nail-puller notch 54 therein.

In use of the implement for removing a representative shingle 14 from the shingled roof, the blade 26 is placed on the exposed surface of the underlying shingle 10, with leading edge 30 of the blade just below lower edge 18 of the overlying shingle 14. Handle 28 is then manually pushed upwardly so that edge 30 of the blade advances into the joint between the two shingles so that the blade underlies shingle 14.

The wedge structure (26,48) keeps the blade at an acute angle to the shingle plane so that the portion of shingle 14 in contact with the blade is lifted away from the underlying shingle 10. As a second step in the process, blade 26 is retracted slightly and then reoriented so that cutter edge 40 is in line with a selected slot 17 in the overlying shingle 14. Handle 28 is pushed a second time to advance the cutter 40 through the shingle 14 material from the upper end of slot 17 to the upper edge 23 of the shingle 14. The portion of the blade 26 to the left of cutter 40 slides along the undeflected portion of the shingle while the cutter cuts through the shingle material. The cutting action is repeated at each slot 17, so that the designated shingle is severed into section for easier removal from the shingled roof. Final separation of a shingle section from the roof surface is accomplished by exerting a lift force on hand grip 36, with leading edge 30 of blade 26 acting as a fulcrum. The shingle is thus lifted and separated from the shingled roof surface.

During upward advancement of blade 26 underneath a selected shingle one of the grooves 44 in blade edge 30 may come into contact with a roofing nail 22. As the blade continues to advance upwardly the roofing nail will be pulled out of the roof surface, along with the selected shingle section.

The nail-puller groove 54 in end 50 of plate 48 is used for pulling nails out of the roof surface that might otherwise escape the action of grooves 44. The implement 24 is pulled downwardly along the bare roof surface so that groove 54 moves beneath the nail head. Handle 28 is then lifted so that end 50 of plate 48 exerts a pull-out action on the nail. Plate 48 has a slight convex curvature, as shown in FIG. 3, to facilitate the action of groove 54.

The drawings show a specific embodiment of the invention. However, it will be appreciated that the invention can be practiced in various forms and configurations.

The present invention, described above, relates to an shingle removing implement. Features of the present invention are recited in the appended claims. The drawings contained herein necessarily depict structural features and embodiments of the shingle removing implement, useful in the practice of the present invention.

However, it will be appreciated by those skilled in the arts pertaining thereto, that the present invention can be practiced in various alternate forms, proportions, and configurations. Further, the previous detailed description of the preferred embodiment of the present invention are presented for purposes of clarity of understanding only, and no unnecessary limitations should be implied therefrom. Finally, all appropriate mechanical and functional equivalents to the above, which may be obvious to those skilled in the arts pertaining thereto, are considered to be encompassed within the claims of the present invention.

What is claimed is:

1. An implement for removing shingles from a building roof comprising:

a flat blade having a leading edge and a trailing edge; said blade having an upper surface and a lower surface;

a handle connected to the blade upper surface proximate to the blade trailing edge;

a plate connected to the blade lower surface for maintaining said blade at an acute angle to the shingle plane when said blade is shoved into the joint between an upper shingle and a lower shingle;

said plate having a first end thereof connected to the blade lower surface at a point proximate to the blade leading edge; and said plate having a second end thereof spaced from the blade lower surface at a point proximate to the blade trailing edge.

2. The implement, as described in claim 1, and further comprising a V-shaped shingle cutting edge indented into the blade leading edge, and plural nail-puller grooves indented into the blade leading edge;

said blade having two side edges connecting the blade leading edge and blade trailing edge; and said V-shaped shingle cutting edge being located in close proximity to one of the blade side edges.

3. An implement for removing shingles from a building roof comprising:

a blade having a leading edge adapted to be inserted into the joint between a first lower shingle forming an underlayer, and a second upper shingle forming an upperlayer;

said blade having an upper surface adapted to engage the undersurface of said upper shingle when the blade is advanced into the joint between said upper and lower shingles;

said blade having an undersurface;

a plate attached to said blade undersurface for maintaining the blade at an acute angle to the shingle plane when the blade is advanced into the joint between the upper and lower shingles;

said plate having a first end thereof attached to said blade at a point set back slightly from the blade leading edge, and a second end thereof spaced from the blade undersurface;

an elongated handle connected to said blade for advancing said blade into the joint, whereby the handle can then be used as a lever to lift said second shingle away from said first shingle; and said handle extending a substantial distance from said blade.

4. The implement, as described in claim 3, wherein said plate has an undersurface that has a slight convex curvature.

* * * * *